US011038275B2

(12) United States Patent
Bermeo et al.

(10) Patent No.: US 11,038,275 B2
(45) Date of Patent: Jun. 15, 2021

(54) BICONE ANTENNA WITH LOGARITHMICALLY EXTENDING CONICAL SURFACES

(71) Applicant: The United States of America as Represented by the Secretary of the Navy, San Diego, CA (US)

(72) Inventors: Dennis Bermeo, San Diego, CA (US); Peter Berens, San Diego, CA (US); David Brock, San Diego, CA (US); Yong Kho, Chula Vista, CA (US); Robbi Mangra, San Diego, CA (US); Dave Arney, El Cajon, CA (US); Linda Hau, San Diego, CA (US); Brandon Wiedemeier, San Diego, CA (US); Jessica Watson, San Diego, CA (US); Lu Xu, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 22 days.

(21) Appl. No.: 16/417,325

(22) Filed: May 20, 2019

(65) Prior Publication Data

US 2020/0373676 A1 Nov. 26, 2020

(51) Int. Cl.
*H01Q 13/04* (2006.01)
*H01Q 9/28* (2006.01)

(52) U.S. Cl.
CPC ..... *H01Q 13/04* (2013.01); *H01Q 9/28* (2013.01)

(58) Field of Classification Search
CPC ..... H01Q 13/04; H01Q 1/38; H01Q 9/28
See application file for complete search history.

(56) References Cited

U.S. PATENT DOCUMENTS 8,654,025 B1 * 2/2014 Brock ..... H01Q 9/28 343/752
8,756,135 B2 6/2014 Klein et al.
9,252,495 B1 2/2016 Jones
9,608,323 B1 3/2017 Berens et al.
(Continued)

OTHER PUBLICATIONS

Ghosh et al., "Design of a Wide-Angle Biconical Antennafor Wideband Communications", Progress in Electromagnetics Research B, vol. 16, 229-245, 2009.

*Primary Examiner* — Hasan Islam
(74) *Attorney, Agent, or Firm* — Naval Information Warfare Center, Pacific; Kyle Eppele; J. Eric Anderson

(57) ABSTRACT

A bicone antenna and methods for manufacture therefor can include a feed portion, a top section and a bottom section that can be centered on a vertical axis. The top section and bottom sections can each have a respective conical surface, which can extend radially outward from the vertical axis at an inner portion at a constant angle $\theta_1$ with respect to a horizontal antenna axis of the antenna. For both sections, the inner portion can merge into an outer portion that can have a curved surface, with the curved surface extending radially outward from the conical surface so that the curved surface has a logarithmic profile when viewed in side profile. The above structure can allow for a multi-directional antenna with a minimum of moving parts, which can be easily manufactured, including by additive manufacturing techniques.

17 Claims, 4 Drawing Sheets

(56) References Cited

U.S. PATENT DOCUMENTS

| | | | | |
|---|---|---|---|---|
| 2007/0241980 | A1* | 10/2007 | Smith | H01Q 9/28 343/773 |
| 2012/0044119 | A1* | 2/2012 | Libonati | H01Q 9/28 343/807 |
| 2012/0176286 | A1* | 7/2012 | Amert | H01Q 9/28 343/773 |
| 2015/0280317 | A1* | 10/2015 | Morin | H01Q 9/28 343/795 |
| 2018/0097289 | A1 | 4/2018 | Jones | |

* cited by examiner

BICONE ANTENNA WITH LOGARITHMICALLY EXTENDING CONICAL SURFACES

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: sssc_pac_t2@navy.mil, referencing Navy Case 104087.

FIELD OF THE INVENTION

The present disclosure can pertain generally to antennas. More particularly, the present disclosure can pertain to bicone antennas having surfaces that can be shaped with a particular geometry, so that the antenna can act as a traveling wave antenna, to allow for multi-directional operation over a wide frequency range.

BACKGROUND OF THE INVENTION

Standard bicone antennas can have insufficiently narrow operating frequency ranges. To extend the frequency range and improve gain, antenna arrays have been designed with multiple antennas, which are designed to cover respective multiple frequency ranges. This configuration can require multiple radio frequency cables and complex electronics. Typical antenna designs can also have positioning or rotary joints to allow an antenna to move in order to receive and/or transmit in multiple directions.

While antenna arrays and positioning/rotary joints provide a multi-directional extended frequency range, this antenna design increase the power required, resulting in high return loss. Also, the use of positioning or rotary joints can induce noise. As a result, such designs typically suffer from low gain.

In view of the above, it can be an object of the present invention to have a stationary antenna design that can have a multi-directional extended frequency bandwidth with improved gain and improved return loss. Another object of the present invention can be to provide a bicone antenna having surfaces that can be shaped with a particular geometry, so that the antenna can act as a traveling wave antenna. Yet another object of the present invention can be to provide a bicone antenna, which can allow for multi-directional operation over a wide frequency range, but with a minimum of moving parts. Still another object of the present invention can be to provide a bicone antenna that can be easy to manufacture, including by additive manufacturing techniques, in a cost-effective manner.

SUMMARY OF THE INVENTION

A bicone antenna and methods for manufacture therefor can include a feed portion centered on a vertical axis, and a top section and a bottom section that can be attached to the feed portion so that the top and bottom sections are also centered on the vertical axis. The top section and bottom section can each have a respective conical surface, which can each extend radially outward from the vertical axis at a respective inner portion at a constant angle $\theta_1$ with respect to a horizontal axis of the antenna. For both sections, the inner portion can merge into an outer portion that can have a curved surface, with curved surface extending radially outward from the conical surface so that the curved surface has a logarithmic profile when the antenna can be viewed in side profile.

The above structure can allow for a multi-directional antenna with a minimum of moving parts, which can be easily manufactured, including by additive manufacturing techniques. These, as well as other objects, features and benefits will now become clear from a review of the following detailed description, the illustrative embodiments, and the accompanying drawings.

BRIEF DESCRIPTION OF THE DRAWINGS

The accompanying drawings, which are incorporated in and form a part of the specification, illustrate example embodiments wherein specific reference characters refer to specifically-referenced parts, and further wherein.

DETAILED DESCRIPTION OF THE EMBODIMENTS

According to illustrative embodiments, a bicone antenna can be provided with a top section and a bottom section that each can include a conical surface having an inner portion and an outer portion. The outer portion of each of the top section and the bottom section can extend logarithmically outward, as described more fully below. Logarithmically extending the conical surface can result in wideband performance with high gain and low return loss.

Figure 1:
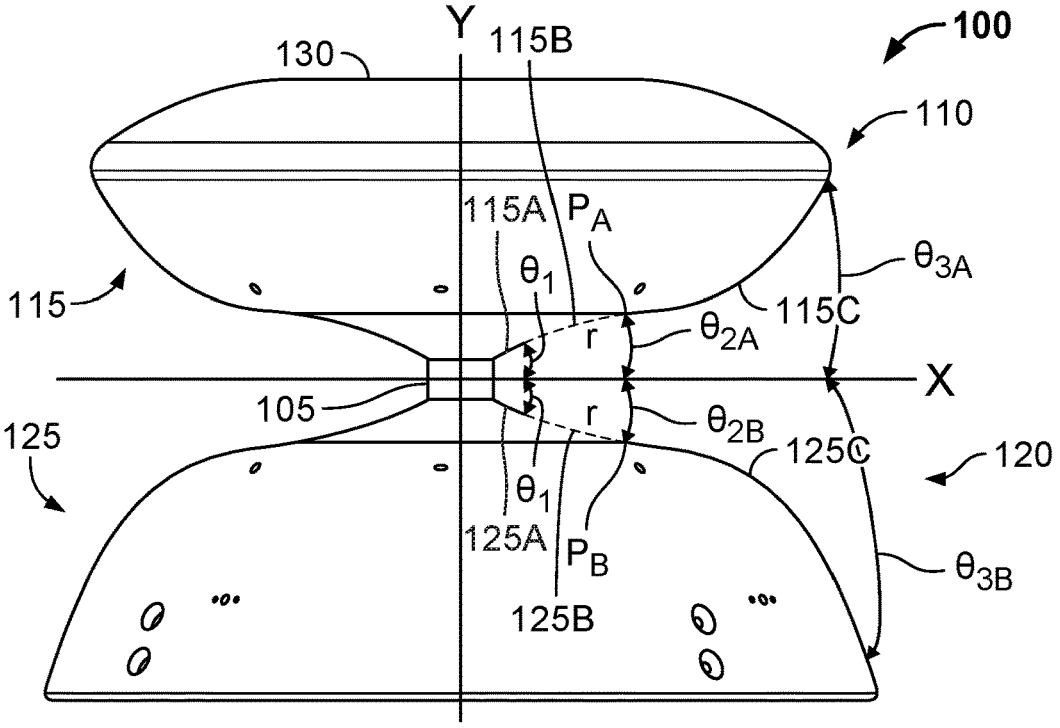
FIG. 1 can illustrate a side view of a bicone antenna according to several illustrative embodiments.
Figure 2:
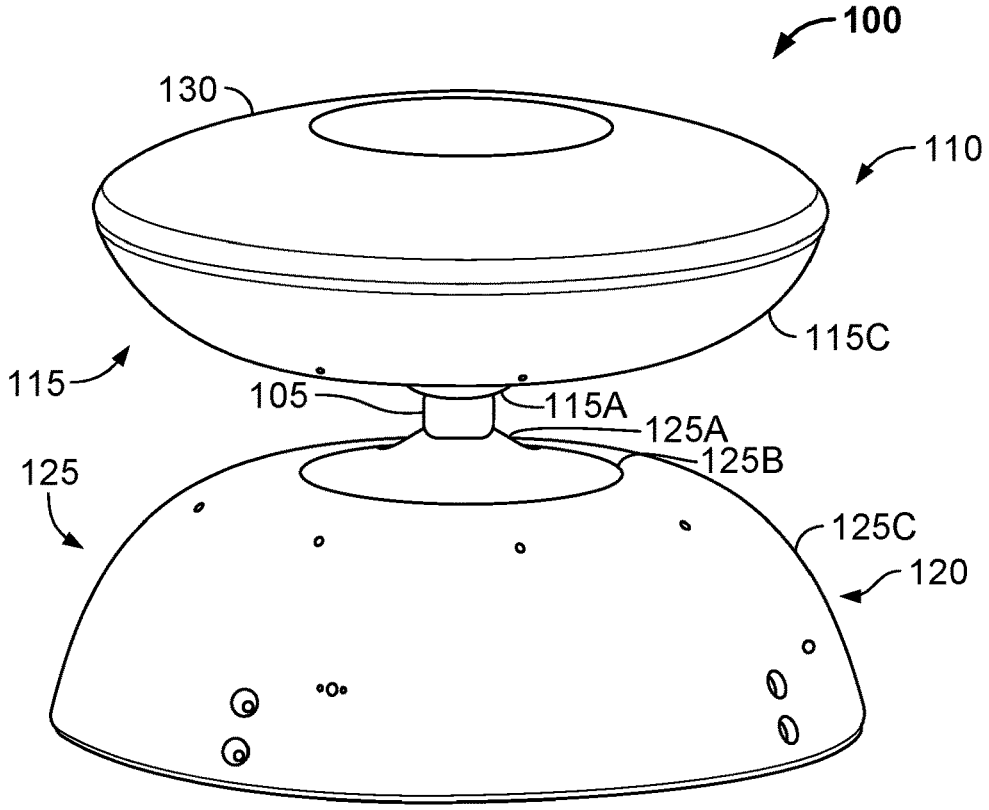
FIG. 2 can illustrate a three-dimensional view of a bicone antenna of FIG. 1 according to several illustrative embodiments.

Referring initially to FIGS. 1-2, FIG. 1 can illustrate a side view of a bicone antenna according to several illustrative embodiments. As shown in FIG. 1, bicone antenna 100 can include a feed portion 105, a top section 110, and a bottom section 120. The feed portion 105 may be fed through the bottom of the bicone antenna 100 via, for example, a small 50 Ohm coaxial cable (not shown).

The top section 110 of the bicone antenna 100 can include a conical surface 115, and the bottom section 120 can include a conical surface 125. The top section 110 of the bicone antenna may also include a top cap 130 with rounded edges to improve reflections.

The conical surface 115 can include a straight inner portion 115A extending outward from the feed portion 105 at a constant angle $\theta_1$ with respect to a horizontal axis x of the bicone antenna 100. The conical surface 115 also can include a transition portion 115B extending from the inner portion 115A and an outer portion 115C extending logarithmically outward.

Similarly, the conical surface 125 can include a straight inner portion 125A extending outward from the feed portion 105 at a constant angle $\theta_1$ with respect to a horizontal axis x of the bicone antenna 100. The conical surface 125 also can include a transition portion 125B extending from the inner portion 125A and an outer portion 125C extending logarithmically outward.

As shown in FIG. 1, the inner portions 115A and 125A each have a shape similar to that of a typical bicone antenna. A typical bicone antenna can allow incoming radio frequency (RF) energy to transfer into the antenna from a given impedance to a given antenna impedance (i.e. 50 Ohms) with a given dielectric $\vartheta$(e.g., $\vartheta \neq 1$ for air). According to illustrative embodiments, the addition of the outer portions 115C, 125C with curved surfaces that can extend logarithmically outward can allow the RF energy to continue travelling through the bicone antenna 100. This can cause the bicone antenna 100 to act as a travelling wave antenna in all directions. Extending the curved surfaces of the outer portions 115C, 125C of the antenna logarithmically outward in a way so that the antenna can act as a travelling wave antenna can increase the antenna gain, which can increase antenna frequency bandwidth and can improve return loss. The curvature of the curved surfaces can be described with more particularity below.

With respect to inner portions 115A, 125A, the angle $\theta_1$ may be selected based on a desired input impedance of the bicone antenna 100. To understand how the angle $\theta_1$ is selected, consider an approximation of the input impendence $Z_{in}$ of an infinite bicone which can be given as:

$$Z_{in}=(120/n)\ln(\cot \theta_{hc}/2) \quad (1)$$

where $\theta_{hc}$ is the half-angle of each conical surface of the bicone antenna with respect to the vertical axis y, and n is the desired input impedance (e.g., 50 Ohms). According to illustrative embodiments, once the half-angle $\theta_{hc}$ is determined, that can provide an impedance $Z_{in}$ that can be close to the desired input impedance n, the constant angle $\theta_1$ of the inner portions 115A, 115B of the respective conical surfaces 115, 125 is selected as $\theta_1=90°-\theta_{hc}$. For example, to achieve an impedance $Z_{in}$ of 48.3 Ohms, $\theta_{hc}$ may be set at 67.5°, resulting in $\theta_1=22.5°$.

Referring again to FIG. 1, the outer portion 115C of the conical surface 115 of the top section 110 can have a curved surface with a first end beginning at point $P_A$ and having an angle $\theta_{2A}$ with respect to the horizontal axis (at $P_A$), where $\theta_{2A}$ is less than $\theta_1$. Similarly, the outer portion 125C of the conical surface 125 of the bottom section 120 has a first end beginning at point $P_B$ and having an angle $\theta_{2B}$ with respect to the horizontal axis, where $\theta_{2B}$ is less than $\theta_1$. From the points $P_A$ and $P_B$, the logarithmically extending outer portions 115C, 125C, when viewed in cross-section, can each have a profile with a shape that is given by:

$$f(x)=B*\ln(A*X)-B \quad (2)$$

where x is a radial distance along the horizontal axis x from the points $P_A$, $P_B$, f(x) can be the distance from the x-axis to the curved surface, and A and B can be constants that affect the shape of the logarithmically extending outer portions 115C, 125C with respect to the horizontal axis x and the vertical axis y. A and B can be chosen by an antenna designer to shape the logarithmically extending outer portion as desired.

As shown in FIG. 1, the outer portion 115C of the conical surface 115 of the top section 110 also can include a second end having an angle $\theta_{3A}$ with respect to the horizontal axis, where $\theta_{3A}$ is greater than $\theta_{2A}$. Similarly, the outer portion 125C of the conical surface 125 of the bottom section 120 also can include a second end having an angle $\theta_{3B}$ with respect to the horizontal axis, where $\theta_{3B}$ is greater than $\theta_{2B}$.

As noted above, the conical surfaces 115, 125 also can include respective transition portions 115B, 125B between the respective inner portions 115A, 125A and the respective outer portions 115C, 115C. The transition portions 115B, 125B are indicated in FIG. 1 by curved dashed lines (the extent of the transition portions 115B, 125B is somewhat exaggerated for illustration purposes). The transition portions 115B, 125B may be formed by chamfering a portion of each of the conical surfaces 115, 125 where the straight inner portions 115A, 125A would otherwise meet the logarithmically shaped curved surfaces of outer portions 115C, 125C. The transition portions 115B, 125B can each have a length and shape represented in FIG. 1 as a radius r. Each of the transition portions 115B, 125B may be chamfered to have a desired length and shape for a given antenna size.

In operation, RF energy arrives at the bicone antenna 100 via a cable fed into the feed portion 105. The RF energy starts transitioning from an input impedance (e.g., 50 Ohms) at the inner portions 115A, 125A of the respective conical surfaces 115, 125 to a lower impedance at the respective first ends of the outer portions 115C, 125C, due to the angles $\theta_{2A}$ and $\theta_{2B}$ being less than $\theta_1$. The RF energy then transitions into a higher impedance at the respective second ends of the outer portions 115C, 125C, due to the angles $\theta_{3A}$ and $\theta_{3B}$ being greater than the angles $\theta_{2A}$ and $\theta_{2B}$, respectively. As the outer portions 115C, 125C of the respective conical surfaces 115, 125 extend logarithmically outward with respect to the horizontal axis, the RF energy exiting the bicone antenna 100 acts as a travelling wave, thus improving gain and allowing a narrower elevation beam width to be achieved.

FIG. 2 can illustrate a three-dimensional view of a bicone antenna according to several illustrative embodiments. For clarity of illustration, some of the reference numerals shown in FIG. 1 have been omitted from FIG. 2. The three-dimensional view of the bicone antenna 100 shown in FIG. 2 represents the two-dimensional side view shown in FIG. 1, rotated by three hundred sixty (360) degrees. As can be seen from FIG. 2, the outer portions 115C, 125C of the respective conical surfaces 115, 125 extend logarithmically in a radial direction from the inner portions 115A, 125A.

As can be seen from FIGS. 1-2 and 4A-4C, the top section 110 and the bottom section 120 of the bicone antenna 100 may be asymmetric so that the bicone antenna fits within a desired volume and/or to allow room for components to fit within the antenna. For example, the angles $\theta_{2A}$, $\theta_{2B}$, $\theta_{3A}$, and $\theta_{3B}$ and the length of the outer portions 115C, 125C of the respective conical surfaces 115, 125 may be adjusted to shape the bicone antenna 100 to fit within a desired volume. The angles $\theta_{2A}$ and $\theta_{2B}$ may be the same or different. Similarly, the angles $\theta_{3A}$ and $\theta_{3B}$ may be the same or different.

Additionally, the shapes and sizes of the top section 110 and bottom section 120 may be adjusted by adjusting the logarithmically extending outer portions 115C, 125C. Also, the length and shape of the transition portions 115B, 125B of the top section 110 and the bottom section 120 may be adjusted to accommodate a desired volume. Further, the shape and the roundness of the edges of the top cap 130 of the top section 110 may be adjusted.

Adjustments of the size and shape of the top section and bottom section of a bicone antenna are described in more detail below with reference to FIGS. 4A-4B.

As noted above, the bicone antenna with logarithmically extending conical surfaces can provide improved gain. As those skilled in the art will appreciate, the gain G of an antenna can be given by:

$$G=E\cdot D \quad (3)$$

where E=efficiency and D=directivity. The efficiency E can refer to the ability of an antenna to transfer energy from an RF feed cable to the antenna, including the energy internally absorbed by the antenna from resistive and dielectric losses. The directivity D refers to the ability of an antenna to focus energy in a particular direction. According to illustrative embodiments, directivity and efficiency can be maximized by allowing the RF energy to act as a travelling wave due to the logarithmically extending outer portions of the conical surfaces. By maximizing the directivity and the efficiency, the gain is maximized.

According to illustrative embodiments, gain can be improved while maintaining return loss. As those skilled in the art will appreciate, return loss is given by:

$$RL(\text{dB})=10\log_{10}(P_i/P_r) \quad (4)$$

where RL(dB) is the return loss in dB, $P_i$ is the incident power and $P_r$ is the reflected power.

Figure 3:
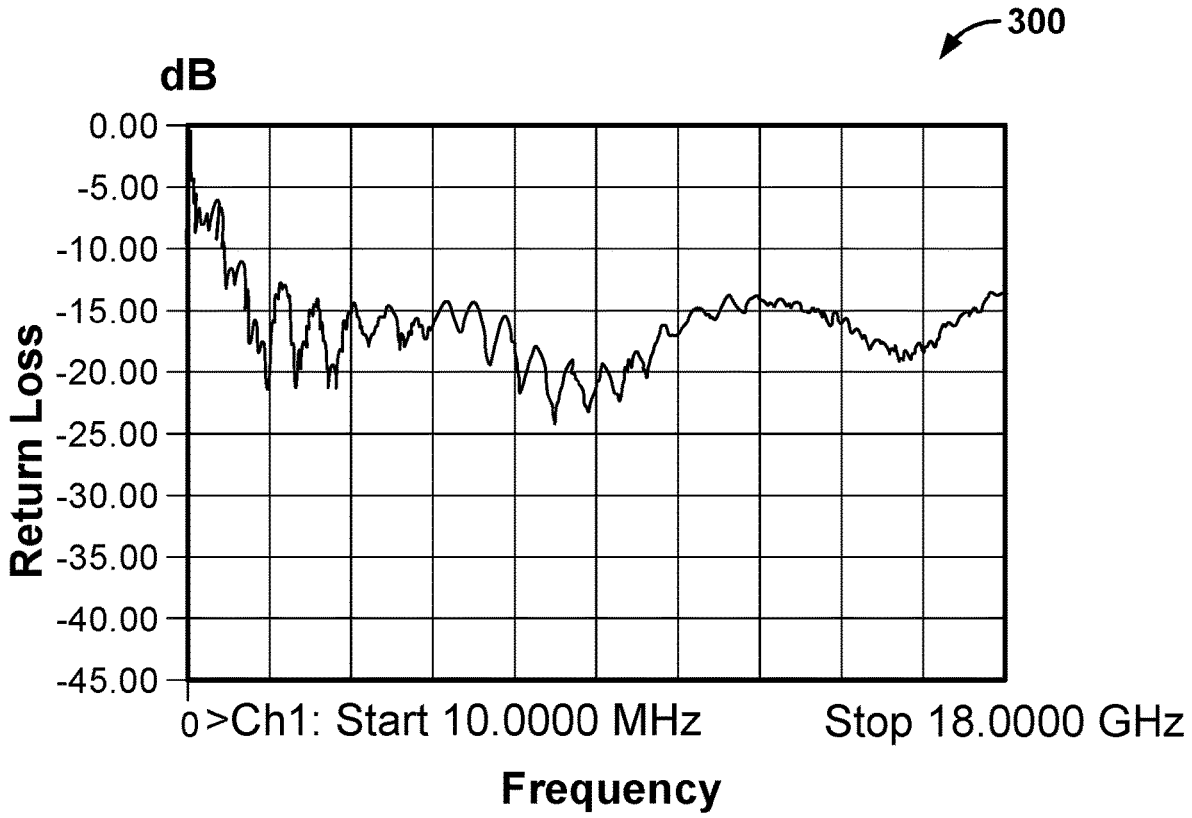
FIG. 3 can be a graph of return loss versus frequency, which can illustrate an example plot of return loss realized by a bicone antenna according to several illustrative embodiments.

FIG. 3 can illustrate an example plot 300 of return loss realized by a bicone antenna according to several illustrative embodiments. In the plot 300, the return loss can be expressed in dB over a range of frequencies from 10 MHz to 18 GHz. As can be seen from the plot 300, the bicone antenna described herein realizes a high return loss over a wide frequency range. This means that RF energy is being transferred efficiently from the RF feed cable into the feed portion of the bicone antenna. Referring to the plot 300 and equation (4) above, a −10 dB return loss equates to approximately 90% of energy transferring from the RF feed cable to the feed portion of the bicone antenna for radiation. Referring to equation (3) above, a high efficiency E implies a high gain G. According to illustrative embodiments, this high gain is realized by the logarithmically extending outer portions of the conical surfaces of the antenna, which allow the antenna to act as a multi-directional, traveling wave antenna over a wide frequency range.

According to illustrative embodiments, the size and shape of a bicone antenna may be adjusted as desired while improving antenna gain and the electrical size of the antenna. For example, the shapes of the top section and the bottom section of a bicone antenna may be adjusted such that the top section and the bottom portion fit within an available volume (the space constraints could of course be balanced against desired gain and frequency range design criteria). This may be understood with reference to FIGS. 4A-4C. For simplicity of illustration, some reference numerals are omitted from FIGS. 4A-4C. However, it should be appreciated that the top section and bottom section of each of the antennas shown in FIGS. 4A-4C include an inner portion, a transition portion, and an outer portion as described above with reference to FIGS. 1 and 2.

Figure 4A:
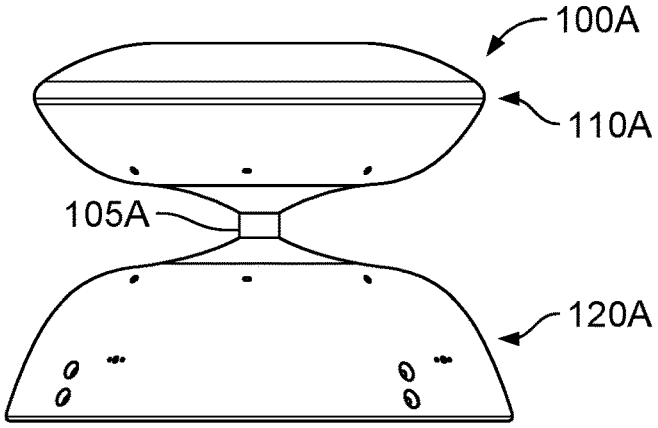
FIGS. 4A-4C can illustrate alternative shapes for a bicone antenna according to illustrative embodiments; and, FIG. 5 can be a flow chart, which can be used to illustrate steps that can be taken to accomplish the methods for providing a bicone antennas, according to several illustrative embodiments.

FIG. 4A can illustrate a bicone antenna 100A with a top section 110A, a bottom section 120A, and a feed portion 105A. The top section 110A and the bottom section 120A of the bicone antenna 100A have shapes similar to the top section 110 and the bottom section 120, respectively, of the bicone antenna 100 shown in FIG. 1.

Figure 4B:
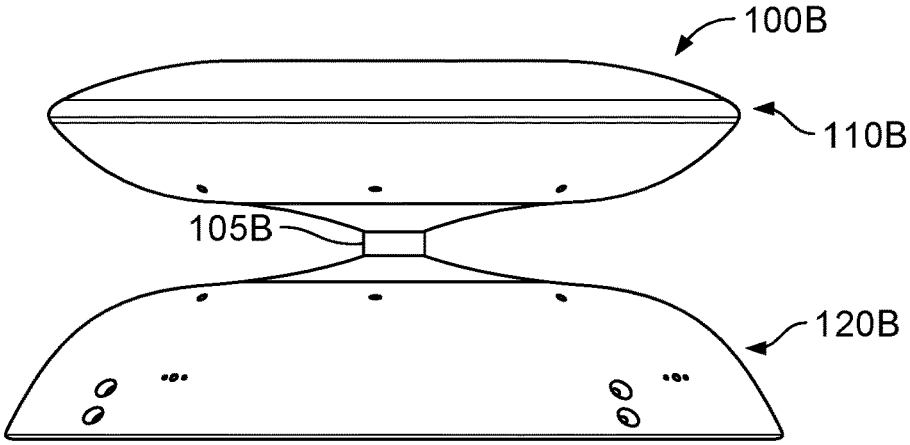
Figure 4C:
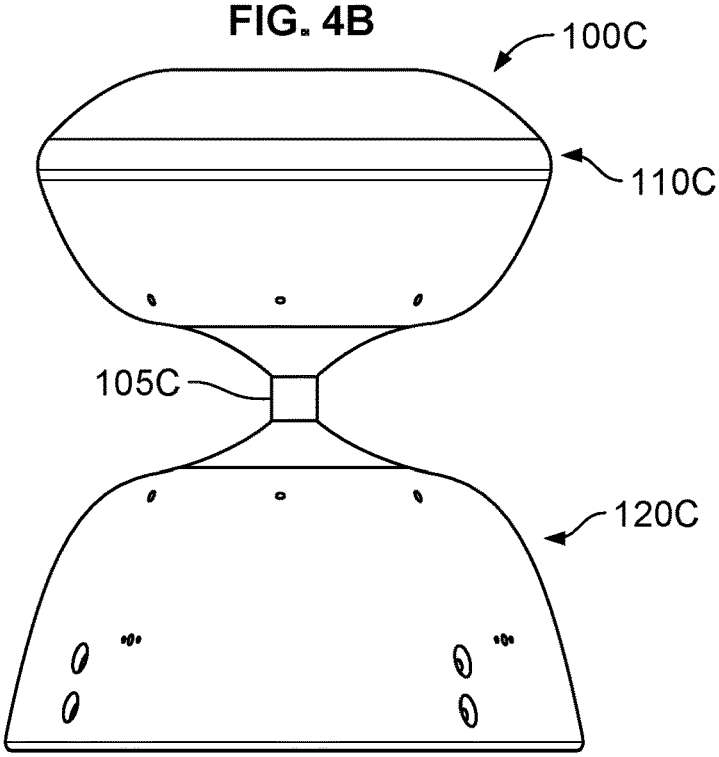

FIGS. 4B and 4C illustrative bicone antennas having alternative shapes. As shown in FIG. 4B, a bicone antenna 100B has a feed portion 105B, a top section 110B and a bottom section 120B that are respectively wider than the feed portion 105A, the top section 110A, and the bottom section 120A of the bicone antenna 100A shown in FIG. 4A. In particular, the top section 110B and the bottom section 120B extend further logarithmically outward, compared respectively to the top section 110A and the bottom section 120A shown in FIG. 4A.

As shown in FIG. 4C, a bicone antenna 100C has a feed portion 105C, a top section 110C, and a bottom section 120C that are respectively narrower but taller than the feed portion 105A, the top section 110A, and the bottom section 120A of the bicone antenna shown in FIG. 4A. In particular, the top section 110C and the bottom section 120C can extend less far logarithmically outward, compared respectively to the top section 110A and the bottom section 120A shown in FIG. 4A.

There are tradeoffs in adjusting the antenna size and shape to fit within a desired volume. For example, an excessive extension of the logarithmically extending outer portions of a bicone antenna could increase the capacitive reactance on the bicone antenna, diminishing the efficiency and bandwidth. Further, adjustment of the size of the bicone antenna may affect reflections for the edges of the top section. Accordingly, an antenna designer should be careful in adjusting the shape and size of a bicone antenna.

Figure 5:
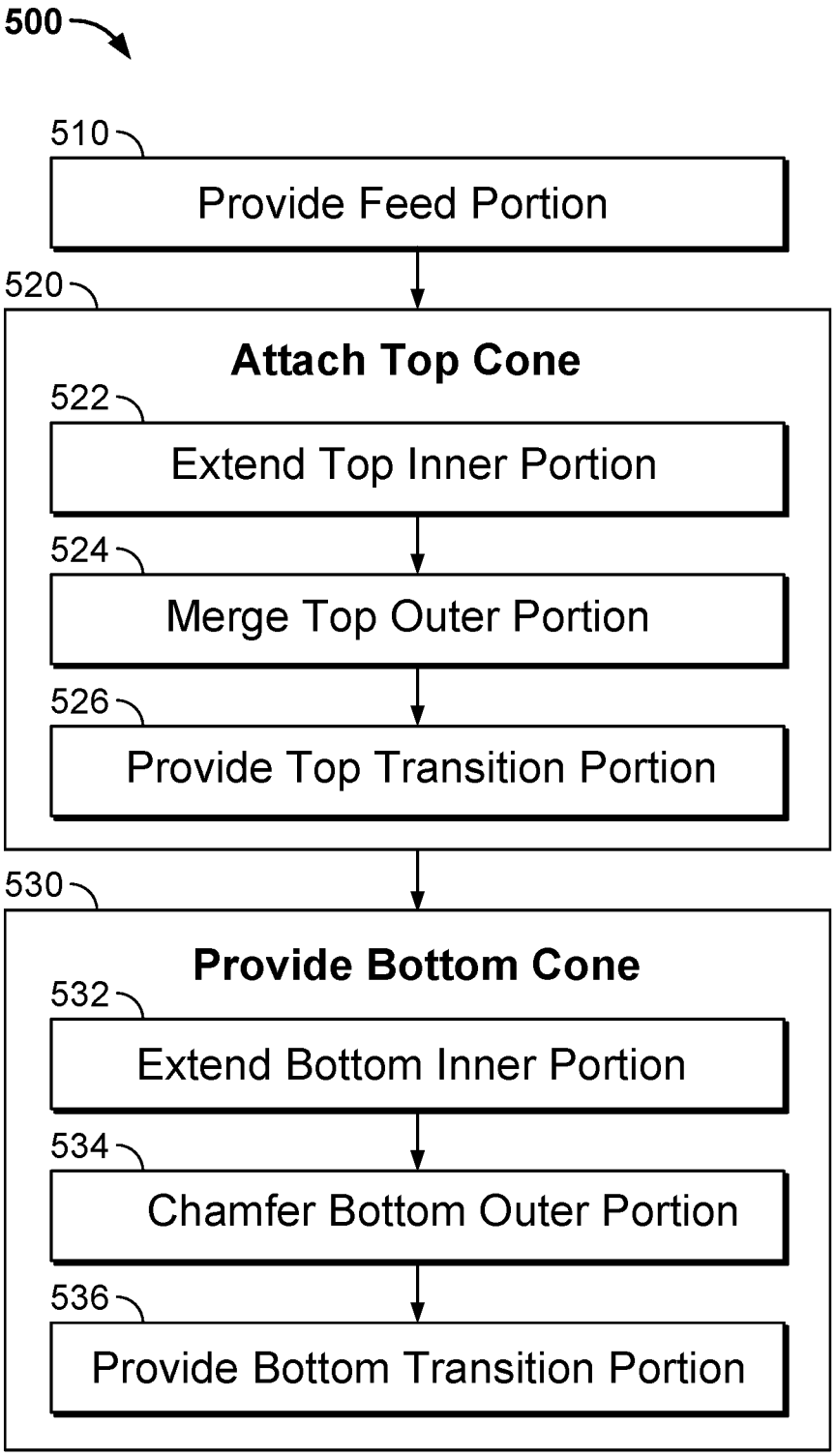

FIG. 5 can be a flow chart, which can be illustrative of steps of a method for providing a bicone antenna according to several embodiments. Referring to FIG. 5, the method 500 begins at step 510, at which a feed portion can be provided.

At step 520, a top cone with a top conical surface can be attached to the feed portion. This step can include the steps of extending a top inner portion of the top conical surface outwardly from the feed portion at a constant angle $\theta_1$ with respect to a horizontal axis of the bicone antenna at step 522. Step 520 can further include merging the top inner portion outwardly into a top outer portion at step 524, so that the top outer portion of the top conical surface can have a profile like logarithmic graph, when the antenna can be viewed in side profile. Step 520 can optionally include providing a top transition portion at step 526. As described above, the top transition portion may be provided by chamfering a portion of top conical surface where the top inner portion and the top outer portion would meet.

As shown in FIG. 5, method 500 can include step 530, attaching a bottom cone with a bottom conical surface to the feed portion, and more specifically to the opposite of the feed portion end where the top cone is attached. This step can include extending a bottom inner portion of the bottom conical surface outwardly from the feed portion at a constant angle $\theta_1$ with respect to a horizontal axis of the bicone antenna at step 532, chamfering bottom inner portion outwardly into a bottom outer portion at step 534, so that the bottom outer portion can have a profile like a logarithmic graph, when the antenna can be viewed in side profile, and optionally providing a top transition portion at step 536. As described above, the top transition portion may be provided by chamfering a portion of the bottom conical surface where the bottom inner portion and the bottom outer portion would meet.

Because of the complex, bulbous curvature of the top cone and bottom cone, one way to accomplish the methods can be to use additive manufacturing techniques to provide the top section (cone), bottom section (cone) and feed portion as a unitary structure, using additive manufacturing techniques. This could result in a single integrated structure, and allows for top and bottom cones with different radii or logarithmic curvature, should such a configuration be desired. Additive manufacture using metal materials could be accomplished, or additive manufacturing of a non-metallic, dielectric materials, followed by coating the dielectric with a metallic material could be used. In sum, additive manufacturing techniques could result in a unitary, integral structure, which would require a minimum of assembly, and which could afford great flexibility in cone geometry, according to the systems and methods of the present invention. It should be appreciated that fewer, additional, or alternative steps may also be involved in the method 500 and/or some steps may occur in a different order and/or that additional or fewer steps may be involved.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

The language used in the specification has been principally selected for readability and instructional purposes, and may not have been selected to delineate or circumscribe the inventive subject matter. Accordingly, the disclosure of the inventive subject matter is intended to be illustrative, but not limiting, of the scope of the invention, which is set forth in the following claims. Many modifications and variations of the embodiments disclosed herein are possible in light of the above description. Within the scope of the appended claims, the disclosed embodiments may be practiced otherwise than as specifically described. Further, the scope of the claims is not limited to the implementations and embodiments disclosed herein, but extends to other implementations and embodiments as may be contemplated by those having ordinary skill in the art.

What is claimed is:

1. An antenna comprising:

a feed portion centered on a vertical axis;

a top section and a bottom section attached to said feed portion;

said top section and said bottom section each having a respective conical surface;

each said conical surface having an inner portion extending radially outward from said vertical axis at a constant angle $\theta_1$ with respect to a horizontal axis of the antenna;

each said inner portion merging into an outer portion having a curved surface, said curved surface extending radially outward from said conical surface so that said curved surface has a logarithmic profile when viewed in side profile;

wherein each one of the tori section and the bottom section also includes a transition portion between and adjoining the inner portion and the outer portion of the respective conical surface of the one of the sections;

wherein the transition portion is concavely curved into the respective conical surface of the one of the sections when viewed in the side profile, and the transition portion extends radially outward away from the vertical axis at a variable angle with respect to the horizontal axis, the variable angle continuously ranging from the angle $\theta_1$ at an inside end of the transition portion to an angle less than the angle $\theta_2$ at an outside end of the transition portion; and wherein the transition portion is concavely curved with a radius r from the inside end to the outside end when viewed in the side profile, the inner portion of the respective conical surface adjoining the inside end of the transition portion, and the outside end of the transition portion adjoining the outer portion of the respective conical surface.

2. The antenna of claim 1, wherein the outer portion of the top section includes a first end having an angle $\theta_{2A}$ with respect to the horizontal axis, where $\theta_{2A}$ is less than $\theta_1$.

3. The antenna of claim 1, wherein the outer portion of the bottom section includes a first end having an angle $\theta_{2B}$ with respect to the horizontal axis, where $\theta_{2B}$ is less than $\theta_1$.

4. The antenna of claim 2, wherein the outer portion of the top section includes a second end having an angle $\theta_{3A}$ with respect to the horizontal axis, where $\theta_{3A}$ is greater than $\theta_{2A}$.

5. The antenna of claim 3, wherein the outer portion of the bottom section includes a second end having an angle $\theta_{3B}$ with respect to the horizontal axis, where $\theta_{3B}$ is greater than $\theta_{2B}$.

6. The antenna of claim 1, wherein the top section includes a top cap that has rounded edges when viewed in the side profile.

7. The antenna of claim 1, wherein the top section and the bottom section are asymmetric, and the top section is shaped to fit within a first volume and the bottom section is shaped to fit within a second volume.

8. The antenna of claim 1 that is a bicone antenna comprising:

the feed portion;

a top cone having the respective conical surface of the top section that is a top conical surface extending from the feed portion; and a bottom cone having the respective conical surface of the bottom section that is a bottom conical surface extending from the feed portion, wherein each of the top conical surface and the bottom conical surface include:

the inner portion extending from the feed portion at the constant angle $\theta_1$ with respect to the horizontal axis of the bicone antenna; and, the outer portion extending logarithmically outward.

9. The bicone antenna of claim 8, wherein each of the top conical surface and the bottom conical surface also includes the transition portion between the inner portion and the outer portion.

10. The bicone antenna of claim 8, wherein the constant angle $\theta_1$ is selected based on an input impedance of a cable feed to the bicone antenna.

11. A method for providing the antenna of claim 1 that is a bicone antenna, the method comprising:

providing the feed portion with a first end and a second end;

attaching a top cone with the respective conical surface of the top section that is a top conical surface to said first end and a bottom cone with the respective conical surface of the bottom section that is a bottom conical surface to said second end;

extending the inner portion of the respective conical surface of the top section that is a top inner portion of the top conical surface outwardly from the feed portion at the constant angle $\theta_1$ with respect to the horizontal axis;

chamfering the top inner portion outwardly into the outer portion of the respective conical surface of the top section that is a top outer portion of the top conical surface, so that the top outer portion of the top conical surface has a logarithmic curve profile when the antenna is viewed in the side profile;

extending the inner portion of the respective conical surface of the bottom section that is a bottom inner portion of the bottom conical surface outwardly from the feed portion at the constant angle $\theta_1$ with respect to the horizontal axis;

chamfering the bottom inner portion outwardly into the outer portion of the respective conical surface of the bottom section that is a bottom outer portion of the bottom conical surface, so that the bottom outer portion of the bottom cortical surface has a logarithmic curve profile when the antenna is viewed in the side profile.

12. The method of claim 11, wherein the chamfering the top inner portion outwardly into the top outer portion includes providing the top outer portion of the top conical surface including:

providing a first end of the top outer portion having an angle $\theta_{2A}$ with respect to the horizontal axis, where $\theta_{2A}$ is less than $\theta_1$; and providing a second end of the top outer portion having an angle $\theta_{3A}$ with respect to the horizontal axis, where $\theta_{3A}$ is greater than $\theta_{2A}$.

13. The method of claim 11, wherein the chamfering the bottom inner portion outwardly into the bottom outer portion includes providing the bottom outer portion of the bottom conical surface including:

providing a first end of the bottom outer portion having an angle $\theta_{2B}$ with respect to the horizontal axis, where $\theta_{2B}$ is less than $\theta_1$; and providing a second end of the bottom outer portion having an angle $\theta_{3B}$ with respect to the horizontal axis, where $\theta_{3B}$ is greater than $\theta_{2B}$.

14. The method of claim 11, wherein:

the chamfering the top inner portion outwardly into the top outer portion includes providing the transition Jordon of the to section that is a top transition portion between the top inner portion and the top outer portion, the top transition portion concavely curved into the top conical surface and the top outer portion convexly curved out of the top conical surface; and the chamfering the bottom inner portion outwardly into the bottom outer portion includes providing the transition portion of the bottom section that is a bottom transition portion between the bottom inner portion and the bottom outer portion, the bottom transition portion concavely curved into the bottom conical surface and the bottom outer portion convexly curved out of the bottom conical surface.

15. The method of claim 11, wherein the attaching the top cone includes shaping the top conical surface to fit within a first volume and the attaching the bottom cone includes shaping the bottom cortical surface to fit within a second volume.

16. An antenna comprising:

a section having a conical surface extending radially outward from a symmetry axis of rotational symmetry of the conical surface, the conical surface including an inner portion, an outer portion, and a transition portion between and adjoining the inner and outer portions, wherein:

the inner portion of the conical surface is straight when viewed in a side profile to the symmetry axis, and the inner portion of the conical surface extends radially outward from the symmetry axis at a constant angle $\theta_1$ with respect to a second axis perpendicular to the symmetry axis through the antenna, the outer portion of the conical surface is convexly curved with a logarithmic curve profile when viewed in the side profile, and the outer portion of the conical surface extends radially outward away from the symmetry axis at a variable angle with respect to the second axis, the variable angle continuously ranging from an angle $\theta_2$ at an inside end of the outer portion to an angle $\theta_3$ at an outside end of the outer portion, where $\theta_2$ is less than $\theta_1$ and $\theta_3$ is greater than $\theta_2$, and the transition portion of the conical surface is concavely curved with a radius r when viewed in the side profile, and the transition portion of the conical surface extends radially outward away from the symmetry axis at a variable angle with respect to the second axis, the variable angle continuously ranging from the angle $\theta_1$ at an inside end of the transition portion to the angle $\theta_2$ at an outside end of the transition portion, the inner portion adjoining the inside end of the transition portion, and the outside end of the transition portion adjoining the inside end of the outer portion.

17. The antenna of claim 16 that is a bicone antenna, wherein the section is a first section, the conical surface in a first conical surface, the transition portion is a first transition portion, the angle $\theta_2$ is an angle $\theta_{2A}$, and the angle $\theta_3$ is an angle $\theta_{3A}$, the antenna further comprising:

a feed portion centered on the symmetry axis, the first section and a second section attached to the feed portion; and the second section having a second conical surface extending radially outward from the symmetry axis of rotational symmetry of the second conical surface, the second conical surface including an inner portion, an outer portion, and a second transition portion between and adjoining the inner and outer portions of the second section, wherein:

the inner portion of the second conical surface is straight when viewed in the side profile to the symmetry axis, and the inner portion of the second conical surface extends radially outward from the symmetry axis at the constant angle $\theta_1$ with respect to the second axis perpendicular to the symmetry axis through the antenna, the outer portion of the second conical surface is convexly curved with a logarithmic curve profile when viewed in the side profile, and the outer portion of the second conical surface extends radially outward away from the symmetry axis at a variable angle with respect to the second axis, the variable angle continuously ranging from an angle $\theta_{2B}$ at an inside end of the outer portion to an angle $\theta_{3B}$ at an outside end of the outer portion, where $\theta_{2B}$ is less than $\theta_1$ and $\theta_{3B}$ is greater than $\theta_{2B}$, and the second transition portion of the second conical surface is concavely curved with the radius r when viewed in the side profile, and the second transition portion of the second conical surface extends radially outward away from the symmetry axis at a variable angle with respect to the second axis, the variable angle continuously ranging from the angle $\theta_1$ at an inside end of the second transition portion to the angle $\theta_{2B}$ at an outside end of the second transition portion, the inner portion of the second section adjoining the inside end of the second transition portion, and the outside end of the second transition portion adjoining the inside end of the outer portion of the second section.

* * * * *